US005700164A

United States Patent [19]

Weidler et al.

[11] Patent Number: 5,700,164

[45] Date of Patent: Dec. 23, 1997

[54] ELECTRICAL CONNECTOR WITH SHIELD

[75] Inventors: Charles Harry Weidler, Lancaster; Michael David Long; Hurley Chester Moll, Jr., both of Harrisburg, all of Pa.

[73] Assignee: The Whitaker Corporation, Wilmington, Del.

[21] Appl. No.: 629,485

[22] Filed: Apr. 10, 1996

[51] Int. Cl.[6] ..... H01R 13/00

[52] U.S. Cl. ..... 439/607

[58] Field of Search ..... 439/607–610, 439/676

[56] References Cited

U.S. PATENT DOCUMENTS

| | | | |
|---|---|---|---|
| 5,017,156 | 5/1991 | Sugiyama | 439/607 |
| 5,030,140 | 7/1991 | Sugiyama | 439/607 |
| 5,073,130 | 12/1991 | Nakamura | 439/607 |
| 5,254,010 | 10/1993 | Davis | 439/108 |
| 5,266,038 | 11/1993 | Nakamura | 439/79 |
| 5,267,882 | 12/1993 | Davis | 439/680 |
| 5,273,459 | 12/1993 | Davis | 439/607 |
| 5,295,843 | 3/1994 | Davis et al. | 439/108 |
| 5,378,172 | 1/1995 | Roberts | 439/607 |
| 5,518,421 | 5/1996 | Davis | 439/607 |

FOREIGN PATENT DOCUMENTS

| | | |
|---|---|---|
| 0 601 265 | 6/1994 | European Pat. Off. . |
| 0 606 739 | 7/1994 | European Pat. Off. . |
| 0 608 813 | 8/1994 | European Pat. Off. . |
| 0 601 265 A3 | 11/1994 | European Pat. Off. . |
| 2 257 577 | 1/1993 | United Kingdom . |

OTHER PUBLICATIONS

U.S. Patent Application Serial No. 08/453,128 filed May 24, 1995 (Abstract and Drawings only included).

International Search Report dated Oct. 2, 1996 in corresponding PCT application.

*Primary Examiner*—Hien Vu

*Attorney, Agent, or Firm*—Anton P. Ness

[57] ABSTRACT

An electrical connector (1) comprises conductive electrical contacts (3) within an insulating housing (2), and a conductive shield (40) encircling the housing (2); a latch (53) latching together portions (51,42) of the shield (40) to enclose the housing (2); and a projecting housing portion (37) impinged against the shield (40). The housing portion (37) biases the housing (2) against the shield (40) to immobilize the housing (2) at a desired position relative to the shield (40).

4 Claims, 4 Drawing Sheets

ELECTRICAL CONNECTOR WITH SHIELD

FIELD OF THE INVENTION

The present invention relates to a shielded electrical connector, and, more particularly, to a shielded electrical connector constructed with an insulating housing and a conductive shield encircling the housing.

BACKGROUND OF THE INVENTION

U.S. Pat. No. 5,518,421 discloses an electrical connector constructed with conductive electrical contacts within an insulating housing, and a conductive shield encircling the housing. The housing and the shield need to remain in fixed positions relative to each other, particularly during mating connection with another mating connector. During such mating connection, the housing engages the mating connector, and tends to be pushed backward by the mating connector. Any movement backward by the housing during such mating would undesirably diminish the wiping travel of one contact against another during such mating. Thus, this electrical connector is further constructed with a feature that resists movement of the housing relative to the shield, such that the shield resists backward movement, or shifting, of the housing.

The housing and the shield are separate parts that are assembled together. A cooperating latching system on the housing and the shield secures the separate parts together. However, the parts vary in size as the result of their being manufactured within allowable dimensional tolerances, and when the parts are assembled and latched to each other, their positions relative to each other can vary due to variations in the sizes of the parts that latch together. As a result, the housing can move relative to the shield, causing the mating end of the housing to change its position relative to a mating end of the shield. A need exists for a feature on an electrical connector that accurately positions the housing and a shield, such that a mating end of the housing is located at a fixed position relative to a mating end of the shield.

SUMMARY OF THE INVENTION

According to the invention, an electrical connector is constructed with a feature that accurately positions an insulating housing and a conductive shield, such that a mating end of the housing is located at a fixed position relative to a mating end of the shield.

According to an embodiment of the invention, an electrical connector comprises a feature that immobilizes an insulating housing relative to a conductive shield.

According to an embodiment of the invention, an electrical connector comprises a portion on an insulating housing that impinges a conductive shell to position the housing relative to the shield.

According to an embodiment of the invention, an electrical connector comprises a compressible portion on an insulating housing that engages the shield to immobilize the housing relative to the shield when the housing and the shield are latched together.

DESCRIPTION OF THE DRAWINGS

An embodiment of the invention will now be described by way of example with reference to the accompanying drawings, according to which.

DETAILED DESCRIPTION

Figure 2:
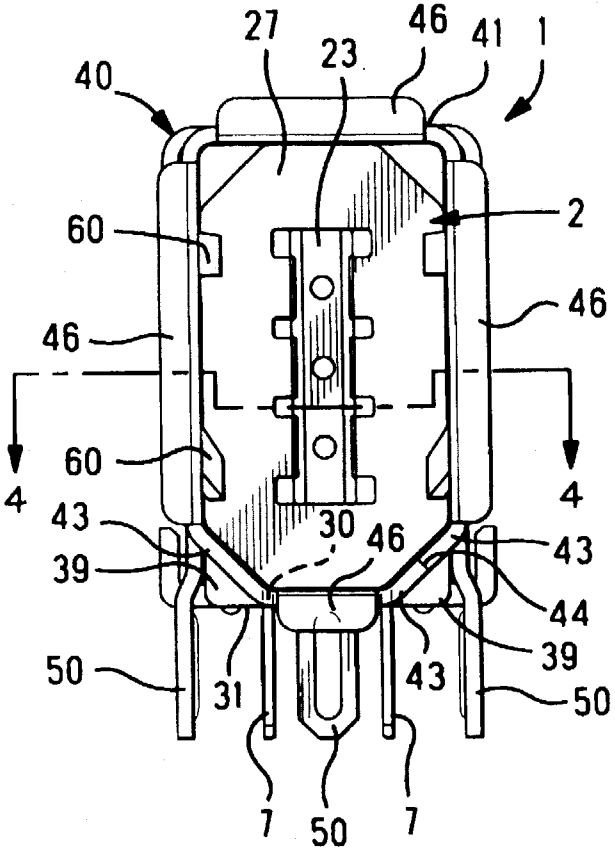
FIG. 2 is a front view of the connector shown in FIG. 1.
Figure 1:
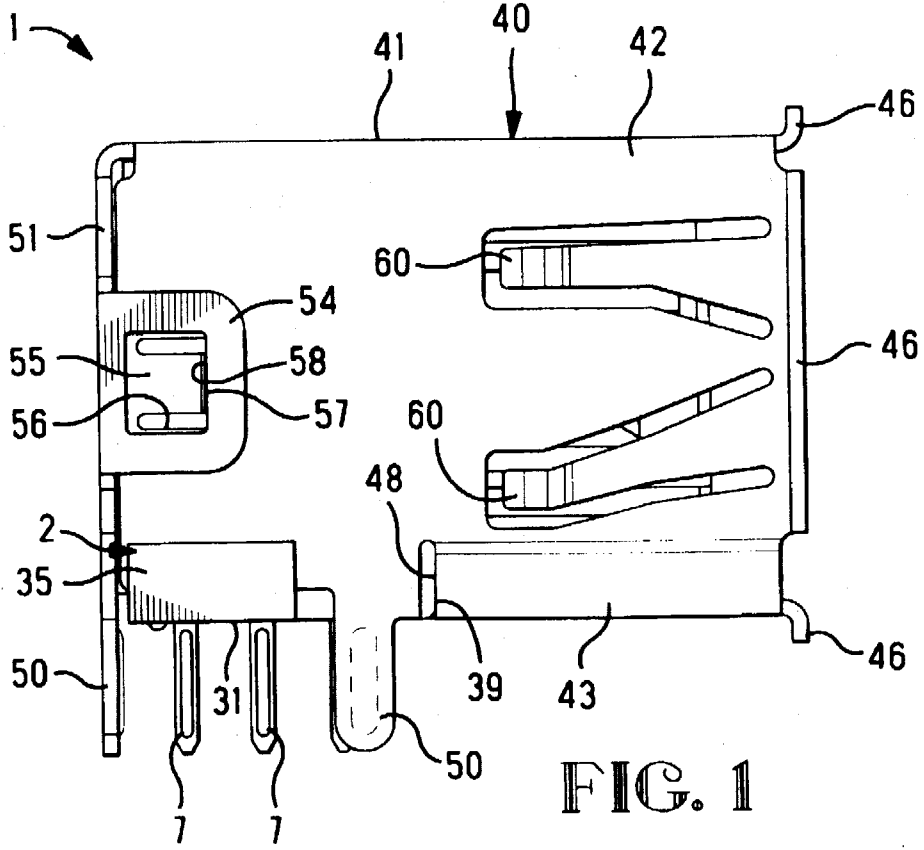
FIG. 1 is a side view of an electrical connector.
Figure 3:
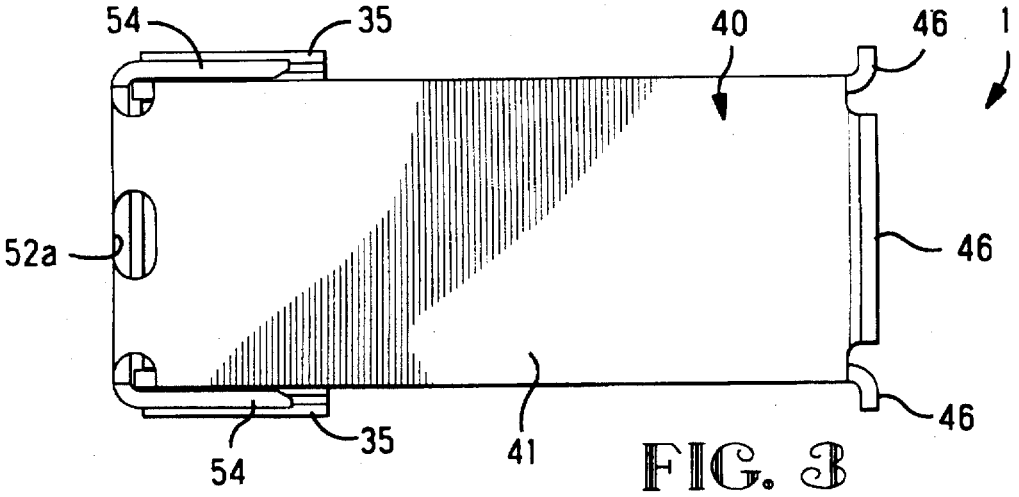
FIG. 3 is a top view of the connector shown in FIG. 1.

With reference to FIGS. 1–6, an electrical connector 1 comprises an insulating housing 2 and multiple electrical contacts 3 assembled thereto. Further details of the connector 1 are described in U.S. patent application Ser. No. 08/453,128, filed May 24, 1995, in the names of the inventors, Charles H. Weidler and Edward E. Knisley, Jr. and assigned to the assignee hereof.

Each of the contacts 3 is of one-piece construction, stamped and formed from a thin sheet of metal having a plane of thickness. Each contact 3 comprises an elongated mating portion 4, a curved central portion (not shown), and an elongated terminal 7. Each contact has an offset 8 (FIG. 4) and a tapered tip 14 on the mating portion 4. Spaced apart on the contact 3 are a front projection 15 and a rear projection 16.

With reference to FIGS. 4 and 6 to 8, the housing 2 is of unitary plastic construction fabricated by molding a plastic material. A contact receiving cavity 20 is in an interior of the housing 2, and a rear 21 of the housing 2 is open. A thin insulating divider 22 (FIGS. 4 and 6) on the housing 2 extends within the cavity 20 and projects forwardly outward of the housing 2 to a front mating end 23. Raised slender walls 24 project outwardly from the surfaces on opposite sides of the slender divider 22. The walls 24 define sides of contact receiving channels 25 that extend along the surfaces on the opposite sides of the divider 22. Each channel 25 extends through a front wall 27 on the housing 2, and communicates with the cavity 20 in the housing 2. Respective channels 25 communicate with larger contact receiving openings 28 in the front wall 27 of the housing 2.

Figure 4:
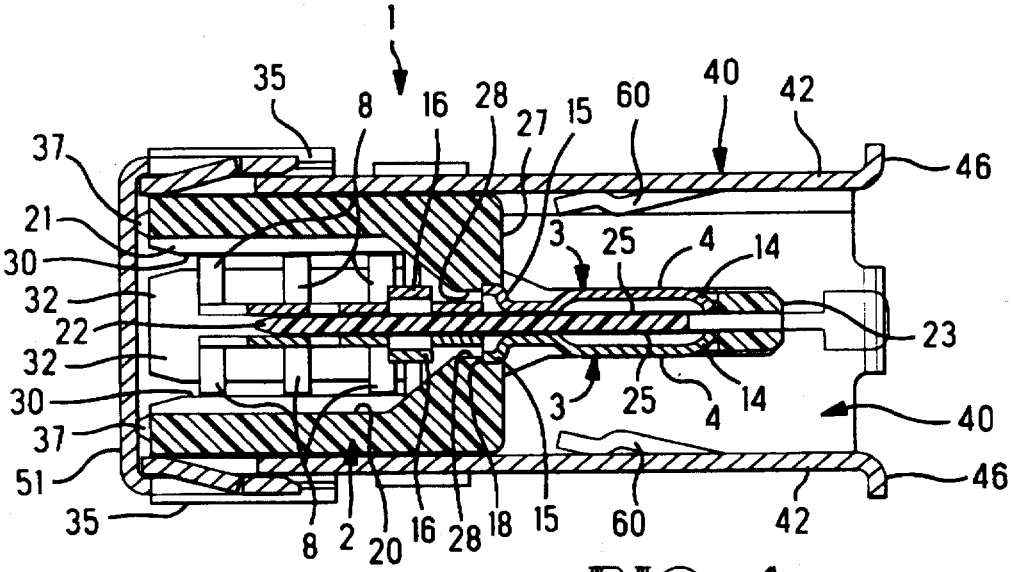
FIG. 4 is a section view of the connector shown in FIG. 1 taken along lines 4—4 thereof.
Figure 5:
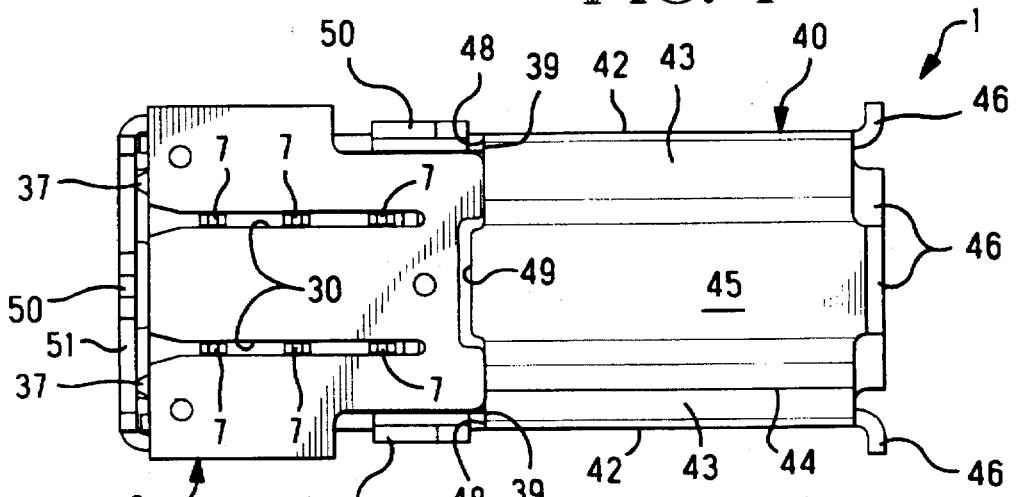
FIG. 5 is a bottom view of the connector shown in FIG. 1.

With reference to FIGS. 4 and 5, two narrow openings 30 extend through a bottom wall 31 of the housing 2, and communicate with the interior cavity 20 of the housing 2. Openings 30 extend parallel to the divider 22 and are spaced by an offset 32 from the divider 22, and communicate with the open rear 21 of the housing 2. Contacts 3 are laterally supported against the divider 22. Front projections 15 enter respective contact receiving openings 28 in the front wall 27 on the housing 2. Front projections 15 wedge in the openings 28 to retain respective contacts 3 in place, and to urge the contacts 3 against the divider 22. Rearwardly facing edges 18 on the projections 15 lance into the housing 2 to restrain the contacts 3 from rearward movement.

During contact insertion, terminals 7 of contacts 3 are received along the narrow openings 30 and project through the bottom wall 31 of the housing 2 (FIG. 2) and outwardly of connector 1. Offsets 8 on the contacts 3 register against an interior surface of the bottom wall 31, and retain contacts 3 within the housing. The mating portions 4 on the contacts 3 extend along the channels 25 between the walls 24, and emerge from the front wall 27 on the housing 2.

Figure 6:
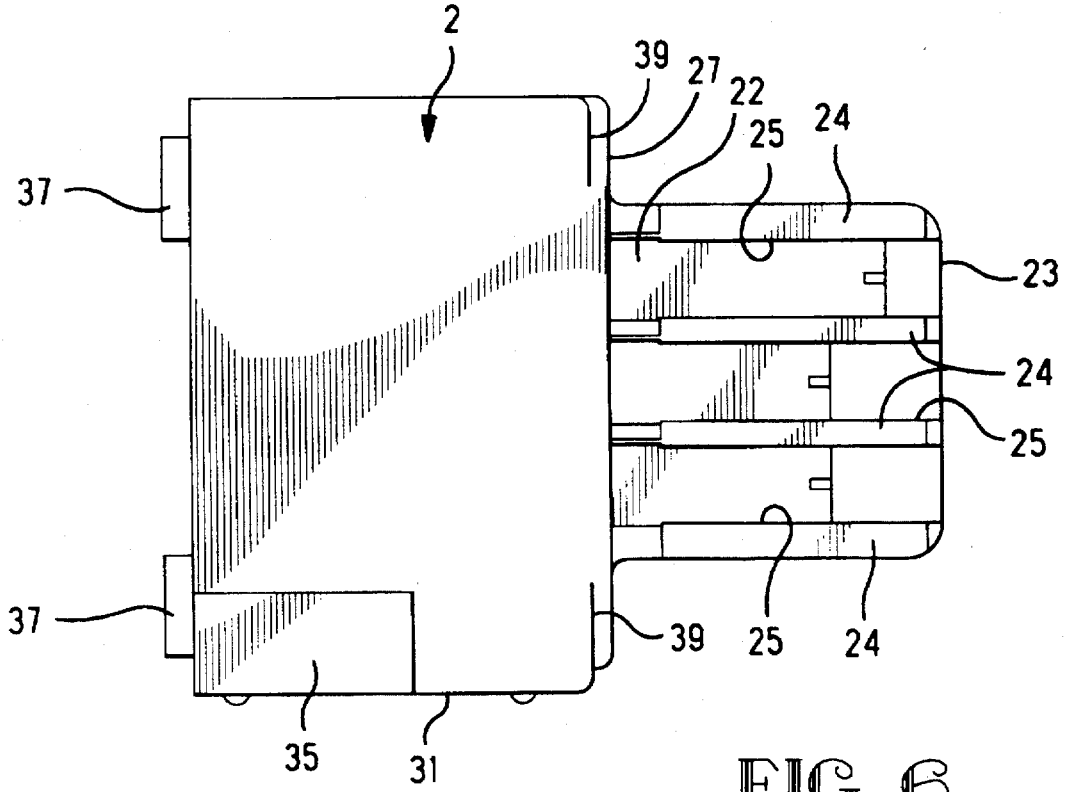
FIGS. 6, 7 and 8 are side, front and rear views of a housing of the connector shown in FIG. 1.
Figure 7:
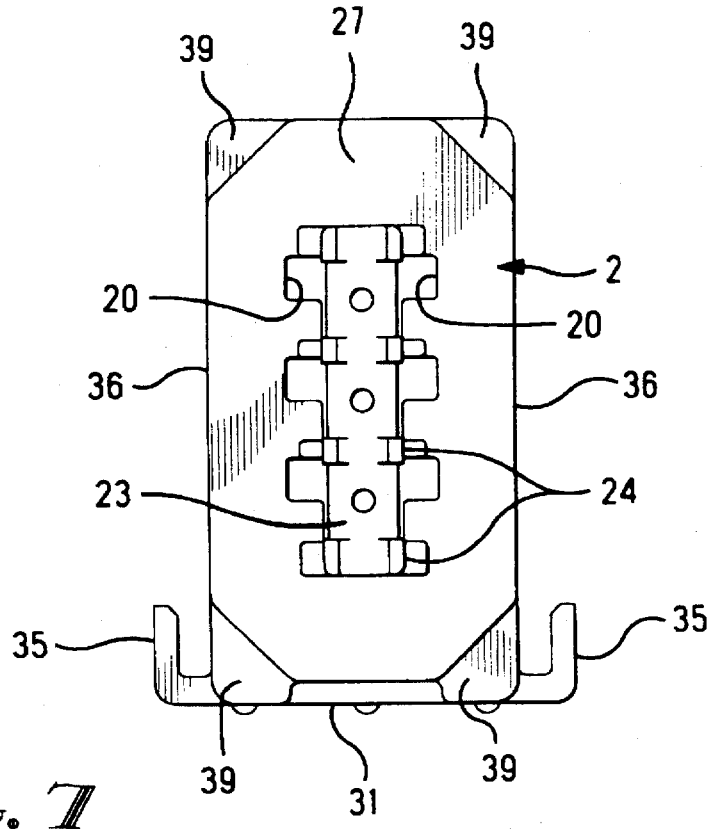
Figure 8:
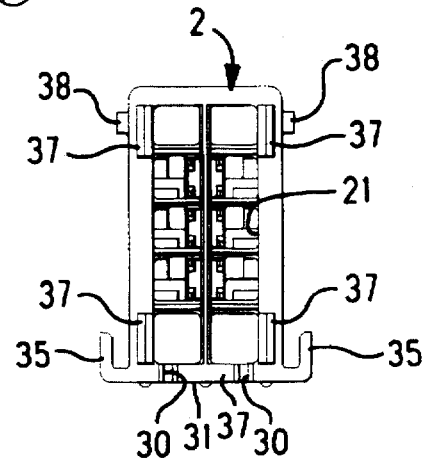

With reference to FIGS. 6 to 8, the housing 2 further comprises a pair of flanges 35 projecting from opposite sides 36 and defining channels. On the rear of the housing 2, a projecting housing portion 37 unitary therewith comprises spaced apart, tapered ridges that are pointed along outer rearward edges. Front wall 27 of the housing 2 has recessed, front facing abutment surfaces 39 along each of the corners of the housing 2.

With reference to FIGS. 1 to 11, the connector 1 further comprises a conductive shield 40 of unitary construction, stamped and formed from a sheet of metal having a plane of thickness. A front portion of shield 40 comprises an enclosure formed by bending the sheet of metal to form the enclosure with a top side 41, contiguous with two opposite sides or side wall 42. In turn, the two sides 42 are contiguous with respective diagonal sides 43. An open seam 44 extends along one of the diagonal sides. A bottom side 45 connects the diagonal sides 43 and is integral with one thereof and extends from a portion of the other. Upturned flanges 46 on a mating front end of the shield 40 project from front edges on respective sides 41, 42 and 45.

Figure 9:
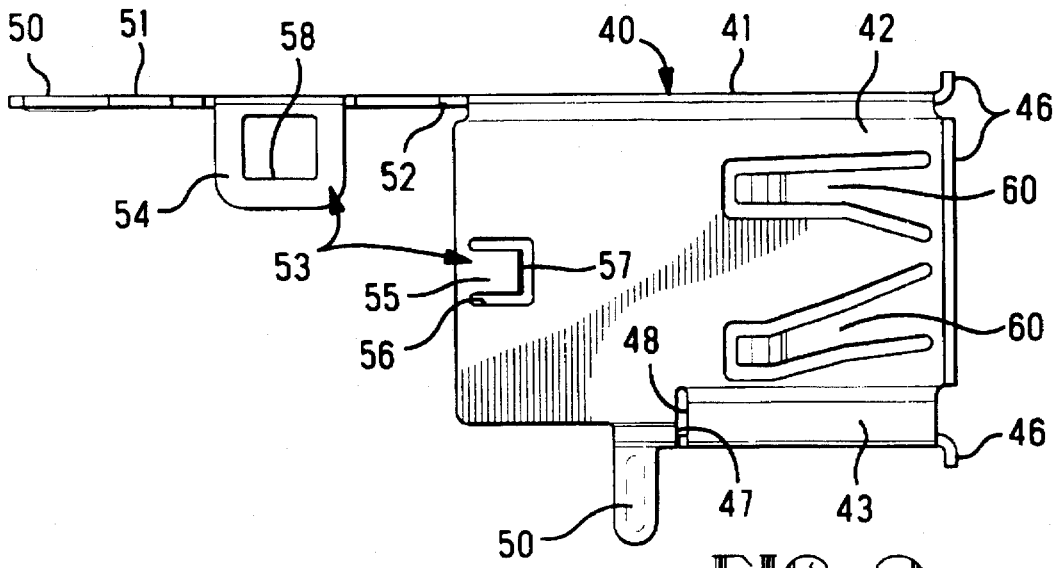
FIGS. 9, 10 and 11 are side, bottom and front views of the shield shown in FIG. 1 prior to connector assembly.
Figure 10:
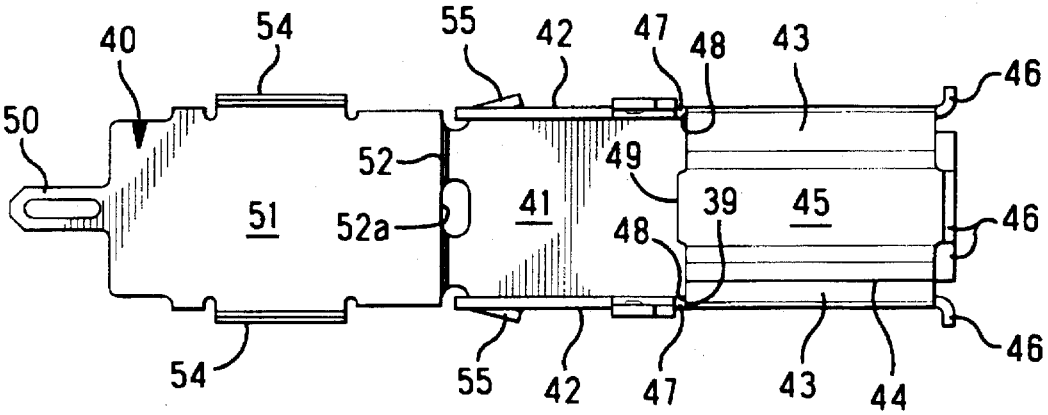
Figure 11:
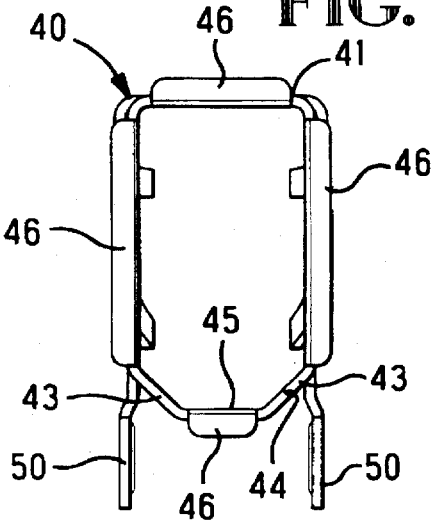

With reference to FIG. 9, each of the diagonal sides 43 of the shield 40 ends in a slit 47 in the shield 40. The slit 47 forms a rearward facing abutment surface 48 formed as an edge on the corresponding rear of the diagonal side 43. The edge 48 is contiguous with a rear edge 49 on the bottom wall 45 (FIGS. 10 and 5). If desired, the edge 48 may be castellated in shape. Rearward of the edge 48, the shield has an open bottom spanning between projecting, electrical terminals 50 that extend from respective sides 42. The terminals 50 and the terminals 7 project in the same direction, downward, for plugging into a circuit board (not shown).

With reference to FIGS. 9 and 10, a rear wall 51 on the shield 40 is joined integrally by a bendable hinge 52 to the top side 41. A stress relief opening 52*a* intersects the hinge 52, to reduce warping of the shield 40 when the rear side 51 is bent downwardly after housing insertion. Another terminal 50 extends from the rear side 51. Latches 53 comprise projecting hasps 54 and projecting tabs 55. The hasps 54 project outwardly from opposite sides of the rear wall 51. The tabs 55 are struck out of the thickness plane of side 42 of the shield 40. A slot 56 through the shield partially circumscribes a corresponding tab 55. A forwardly facing latch surface 57 on each tab 55 desirably engages tightly against a rear facing latch surface 58 on a respective hasp 54. Resilient spring contacts 60 are struck out of the plane of thickness of sides 42 of shield 40 to project inwardly and rearwardly. Contacts 60 will engage sidewalls of a plug portion of another mating electrical connector (not shown) that is inserted into the mating front end of shield 40 to mate with the connector 1.

Contacts 3 are assembled to the housing 2, and together, the housing 2 (with its contacts 3) are assembled through the rear opening of the shield 40, before the rear wall 51 is bent downward to close the rear opening of the shield 40. Bottom edges of the sides 42 on the shield 40 rest along and within respective channels formed by flanges 35 on housing 2. The rear wall 51 is then bent downwardly to close the rear of the shield 40 for latches 53 to engage, thus enclosing the housing 2 in the shield 40.

Housing 2 and shield 40 are separate parts that are assembled together. The parts vary in size as the result of their being manufactured within allowable dimensional tolerances. When the parts are assembled and latched to each other, their positions relative to each other can vary due to variations in the sizes of the parts that latch together. As a result, the housing 2 can move relative to the shield 40, causing the mating end 23 to vary in its position relative to a mating end of the shield 40. Accordingly, the housing 2 and the shield 40 are provided with a construction that accurately positions the housing 2 and the shield 40, such that the mating end 23 is located at a fixed immobile position relative to a mating end of the shield 40. Accordingly, with reference to FIGS. 1 and 5, respective front facing abutment surfaces 39 on the housing impinge against respective rear facing abutment surfaces 48 on the shield 40 to resist forward movement of the housing 2 relative to the shield 40.

The projecting housing portion 37 on the housing 2, is impinged against the rear wall 51 on the shell 40, and biases the housing 2 against the shield 40 to immobilize the housing 2 at the desired position relative to the shield 40. The latches 53, comprising the hasps 54 and the tabs 55, resist rearward movement of the housing 2 relative to the shell 40. The pointed part on the projecting housing portion 37 is crushable against forwardly facing major surfaces of rear wall 51 of the shield 40 to adjust the position of the housing 2 relative to the shield 40. Accordingly, the pointed housing portion 37 is constructed to undergo compressive deflection when crushed. The amount of compressive deflection varies, depending upon the different sizes of the parts. The projecting housing portion 37 projects outwardly with a dimensional height that is chosen to be sufficient to bridge across a space between the rear face on the housing 2 and a rear side 51 on the shield 40. The rear wall 51 of the shell 40 will engage the projecting housing portion 37, even for the largest space that will be present when parts of various sizes are assembled with one another. Further, the projecting housing portion 37 biases the housing 2 forwardly against the shield 40 to position the mating front end 23 on the housing 2 at a desired immobile position relative to a mating end of the shield 40, after rear wall 51 is latched to side walls 42 affixing it in position.

Although a preferred embodiment of the invention is disclosed, other embodiments and modifications of the invention are intended to be covered by the spirit and scope of the accompanying claims.

What is claimed is:

1. An electrical connector comprising:

conductive electrical contacts within an insulating housing, and a conductive shield encircling the housing, the shield having a rear wall movable into position opposite a rear face of the housing and spaced a small distance therefrom upon being affixed to side walls of the shield, the housing rear face including at least one projecting housing portion of the same material as the housing, at least one said projecting housing portion being impinged compressively against a forwardly facing major surface of said rear wall on the shield, at least one said projecting housing portion dimensioned to slightly exceed said small distance between the rear shield wall and the housing rear face and adapted to be compressively deflected, and said at least one projecting housing portion upon engagement by said rear wall biasing the housing forwardly until forwardly facing surfaces of the housing abut against rearwardly facing surfaces of the shield to position a mating front end of the housing at a desired immobile position relative to a mating end of the shield, whereafter said rear shield wall becomes affixed in position and at least one said projecting housing portion is and remains compressively deflected by said rear wall major surface.

2. The connector as set forth in claim 1 wherein said at least one projecting housing portion is tapered generally to have a triangular cross-section.

3. An electrical connector comprising:

conductive electrical contacts within an insulating housing, and a conductive shield encircling the housing and including a rear wall, a latch comprising at least one rear facing latch surface on the shield rear wall being received against a corresponding front facing latch surface on side walls of the shield, said latch surfaces engaging each other to resist rearward movement of the housing upon connector assembly, the rear shield wall being movable during assembly into position opposite a rear face of the housing and spaced a small distance therefrom upon complete assembly, the housing rear face including at least one projecting housing portion of the same material as the housing, at least one said projecting housing portion dimensioned to slightly exceed said small distance between the rear shield wall and the housing rear face and adapted to be compressively deflected, and said at least one projecting housing portion upon engagement by said rear wall biasing the housing forwardly until forwardly facing surfaces of the housing abut against rearwardly facing surfaces of the shield being crushable against the shield to bias said latch surfaces against each other to position a mating front end of the housing at a desired immobile position relative to a mating end of the shield, whereafter said rear shield wall becomes latched to said shield side walls and at least one said projecting housing portion is and remains compressively deflected by said rear wall major surface.

4. The connector as set forth in claim 3 wherein said at least one projecting housing portion is tapered generally to have a triangular cross-section.

* * * * *

UNITED STATES PATENT AND TRADEMARK OFFICE

CERTIFICATE OF CORRECTION

PATENT NO. : 5,700,164
DATED : Dec. 23, 1997
INVENTOR(S) : Charles H. Weidler, et al It is certified that error appears in the above-identified patent and that said Letters Patent is hereby corrected as shown below:

Title page, insert the following:

--Related U.S. Application Data
[60] Provisional application No. 60/000,273, Jun. 16, 1995--.

Column 1, line 2, insert the following:

--CROSS REFERENCE TO RELATED APPLICATION
Reference is made to and priority claimed from U.S. Provisional application Ser. No. US 60/000,273, filed June 16, 1995, entitled ELECTRICAL CONNECTOR WITH SHIELD.--

Signed and Sealed this

Fifteenth Day of September, 1998

Bruce Lehman

*Attest:*

BRUCE LEHMAN

*Attesting Officer*

*Commissioner of Patents and Trademarks*